United States Patent [19]

Kasuya et al.

[11] Patent Number: 4,473,628

[45] Date of Patent: Sep. 25, 1984

[54] TONER FOR DEVELOPING OF ELECTROSTATIC LATENT IMAGE

[75] Inventors: Takahira Kasuya; Hideaki Morita, both of Hachioji; Goichi Yamakawa, Hidaka; Makoto Tomono, Hino; Isao Furuta, Suzuka; Minoru Tsuneyoshi, Yokkaichi, all of Japan

[73] Assignee: Konishiroku Photo Industry Co., Ltd., Tokyo, Japan

[21] Appl. No.: 558,993

[22] Filed: Dec. 6, 1983

Related U.S. Application Data

[63] Continuation of Ser. No. 350,430, Feb. 22, 1982, abandoned.

[30] Foreign Application Priority Data

Mar. 13, 1981 [JP] Japan ..... 56-035172

[51] Int. Cl.[3] ..... G03G 9/08

[52] U.S. Cl. ..... 430/109; 430/110; 430/137

[58] Field of Search ..... 430/137, 109, 110, 528

[56] References Cited

U.S. PATENT DOCUMENTS 4,246,332 1/1981 Tanaka et al. ..... 430/124

4,299,903 11/1981 Au Clair et al. ..... 430/110

*Primary Examiner*—John E. Kittle

*Assistant Examiner*—John L. Goodrow

*Attorney, Agent, or Firm*—Jordan B. Bierman; Linda Bierman

[57] ABSTRACT

A toner for developing an electrostatic latent image comprising a resin prepared by emulsion polymerization of a first polymer to yield a first emulsion, emulsion polymerization of a second polymer to yield a second emulsion, mixing said first and second emulsions and coagulating said mixture, wherein said second polymer has characteristics different from those of said first polymer.

7 Claims, No Drawings

TONER FOR DEVELOPING OF ELECTROSTATIC LATENT IMAGE

FIELD OF THE INVENTION

The present invention relates to a toner for developing an electrostatic latent image formed in electrophotography, electrostatic printing and electrostatic recording.

BACKGROUND OF THE INVENTION

Most of the currently used toners for developing an electrostatic latent image comprise particles of a binder resin having a colorant and a charge control agent and other additives dispersed or otherwise incorporated therein. Magnetic toners, which use fine magnetic particles instead of the colorant or which comprise fine magnetic particles together with the colorant, are also used on a commercial scale.

The properties of the binder resin have a predominant effect on the properties of the resulting toner. Various synthetic and/or natural resins are used as the binder resin, but the modern high-performance copiers have rigorous requirements to meet with respect to development and other electrophotographic processes, and the binder resin to be used as a toner has its own rigorous requirements to satisfy. Since it is difficult for a single resin to meet the requirements, a mixed resin comprising a plurality of resins having different characteristics has been proposed. It is generally agreed that using such mixed resin in a binder resin is effective in improving the properties of the toner such as image fixing ability, charging ability and charge retaining ability, increasing the grindability of the resulting resin, as well as in preventing the toner filming that takes place when some toner particles are stuck onto the surface of a charge retaining member and carrier particles during development.

When the mixed resin is used in a binder resin, the individual resin components must form an intimate mixture. Otherwise, the visible image obtained by developing has fog or is fixed inadequately and, in addition, the resulting toner particles do not have great durability.

The process for producing toner particles generally consists of four steps: (1) a preliminary mixing step wherein a resin in a granular or other particulate form is mixed with a colorant and other additives; (2) a melting and kneading step wherein the mixture is put into a kneader where it is melted and keneaded to have the colorant and other additives dispersed in the resin uniformly; (3) grinding step wherein the resulting compound is ground into fine particles; and (4) a classification step for obtaining toner particles within a predetermined range of grain size. In the conventional technique, two resins that make up a binder resin are blended in the preliminary mixing step. Although the individual resin components are mixed further in the subsequent melting/kneading step, a completely uniform mixture is not obtained by the conventional technique since only mechanical and thermal means are used to mix the individual resins. If the resulting resin mixture is used as toner, a visible image with fog or one which cannot be fixed adequately is formed as a result of development, and the advantages of using two resins are lost. To provide an intimate resin mixture extended kneading is necessary and yet the resulting mixture is not completely uniform. The kneading operation itself becomes difficult if the resins have greatly different melt viscosities or if they have little miscibility with each other.

SUMMARY OF THE INVENTION

Therefore, one object of the present invention is to provide a toner for developing an electrostatic latent image which uses a binder resin that comprises an intimate mixture of resin components.

This object can be achieved by a toner for developing an electrostatic latent image that uses, as a binder resin, a resin which is prepared by mixing two emulsions, coagulating the emulsion mixture, separating the solid from the latex serum, and dehydrating the same into a solid product. One of the two emulsions is a first polymer emulsion produced by emulsion polymerization, and the other is an emulsion of a second polymer that is also produced by emulsion polymerization and which has different characteristics than those of the first polymer.

The toner binder resin of the present invention comprises a mixture of emulsions of two resins each consisting of very fine particles generally in the range of from 0.1 to 8 microns. So, the material to be subjected to the melting and kneading step is already a highly uniform mixture of resins, and by melting and kneading the mixture with a colorant and other additives in a kneader, a toner having completely uniform composition and characteristics is produced in a shorter period of time.

DETAILED DESCRIPTION OF THE INVENTION

The toner according to the present invention is produced by the following procedure:

(1) emulsions of two polymers having different characteristics are prepared by emulsion polymerization;

(2) the two emulsions are mixed;

(3) the emulsion mixture is coagulated, and the resin mixture is separated from the latex serum and dehydrated to provide a solid product;

(4) the solid resin product is preliminarily mixed with a colorant and other additives;

(5) the mixture is melted and kneaded; and (6) the compound is ground into particles which are then classified to be within a predetermined range of grain size.

One preferred example of the mixed resin that can be used in the binder resin of the present invention is a mixture of styrene/butadiene copolymers. The mixed resin may also be composed of two resins having different degrees of polymerization or compositions. A particularly effective binder resin is produced from a mixture of an emulsion of high-molecular weight polymer obtained by emulsion polymerization and an emulsion of a low molecular weight polymer also produced by emulsion polymerization. The toner that uses a binder resin obtained by coagulating and dehydrating this type of mixture has great ability to fix developed images at relatively low temperatures. The toner is also very effective in preventing off-setting phenomenon when the image is fixed by a contact thermal fixing system using rollers because it raises the temperature at which off-setting phenomenon occurs.

If two styrene/butadiene copolymers are used as the high molecular weight polymer and the low molecular weight polymer, the two copolymers may have the same styrene/butadiene ratio and have different degrees of polymerization, or to provide a toner with better characteristics, the copolymers may have different degrees of polymerization and different styrene/butadiene ratio.

The most important feature of the present invention is to use a binder resin comprising a mixture of two resins having different characteristics and which are mixed as two emulsions. By using such a binder resin a toner having high development efficiency, image fixing ability, durability and resistance to agglomeration is produced. In addition, such a binder resin can be easily ground into fine particles suitable as toner particles. These advantages are exhibited most effectively when the binder resin is composed of only the mixed resin obtained by mixing resin emulsions, but they are not lost if the binder resin is made of such mixed resin plus a third resin. More specifically, the above described mixed resin can be mixed with a natural resin or a synthetic resin produced by any method of polymerization such as emulsion polymerization, suspension polymerization or block polymerization. The resulting mixture, may be blended with a pigment and other additives and the composition is melted and kneaded into a uniform mixture from which a toner having better properties than those of the conventional toner is produced. This technique exhibits a particularly good advantage if a resin a must be melted and kneaded with a resin b which is not highly miscible with the resin a; in this case, an emulsion of the resin a is mixed with an emulsion of a resin c that is highly miscible with the resin b, and the resulting mixture becomes highly miscible with the resin b and an intimate resin mixture is produced in the subsequent melting and kneading step.

Accordingly, not only the mixed resin specified above but also another resin can be incorporated in the binder resin. The additional resin is preferably used in an amount of less than 40 wt % of the binder resin. Examples of the additional resin include a vinyl resin such as styrene resin, styrene/acrylic acid ester copolymer resin, styrene/methacrylic acid ester copolymer or styrene/butadiene resin, an epoxy resin, polyester resin, polyether resin, cellulosic resin, rosinmodified phenolic resin and polyurethane resin. A resin having high miscibility with the mixed resin is preferably used as the additional resin; if the mixed resin is a styrene/butadiene copolymer, the additional resin is preferably a styrene resin, styrene/acrylic acid ester copolymer resin or styrene/methacrylic acid ester copolymer resin.

The toner of the present invention is produced by dispersing among the particles of the binder resin other toner components such as a pigment or dye and optional additives such as charge control agent. Alternatively, fine magnetic particles containing a colorant may be dispersed in the binder to form a magnetic toner. The resulting toner particles generally have a grain size of from 1 to 50 microns, preferably from 3 to 20 microns. Examples of the colorant are carbon black, Nigrosine (C.I. No. 50415 B), Aniline Blue (C.I. No. 50405), Chalcoil Blue (C.I. No. azoec Blue 3), Chrome Yellow (C.I. No. 14090), Ultramarine Blue (C.I. No. 77103), Du Pont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp black (C.I. No. 77266), Rose Bengale (C.I. No. 45435), and mixtures thereof. These colorants must be incorporated in a sufficient amount to provide a high-density visible image upon development, and usually, they are contained in an amount of from 1 to 20 parts by weight per 100 parts by weight of the binder resin.

Examples of the magnetic particles used to produce a magnetic toner are ferrite, magnetite and other metals containing ferromagnetic elements such as iron, cobalt and nickel; alloys or compounds containing these metals; or Heusler's alloys such as Mn-Cu-Al or Mn-Cu-Sn that do not contain ferromagnetic elements but which turn ferromagnetic upon heat treatment or other suitable treatment; or chromium dioxide. The fine particles of these magnetic materials are generally contained in an amount of 20 to 70 wt %, preferably from 40 to 70 wt %, of the toner.

The toner according to the present invention can be produced by the conventional method; a mixture of the binder resin described above with a colorant, fine magnetic particles or other suitable additives is stirred in, say, a ball mill for 24 hours to form a uniform dispersion; the dispersion is then kneaded with a hot roll and cooled; the cooled mass is ground into particles which are classified to obtain the toner particles of the present invention having a predetermined range of grain size.

As described in the foregoing, the toner of the present invention uses a binder resin the major component of which is a mixture of emulsions of two polymers that are prepared by emulsion polymerization and which have different characteristics. The two resins form a highly uniform mixture and the advantages of using two resins are exhibited fully to thereby produce a toner having good characteristics.

The present invention is now described in greater detail by reference to the following examples and comparative examples which are given here for illustrative purposes only and are by no means intended to limit its scope. In the examples and comparative examples, all parts are by weight.

EXAMPLE 1

| Preparation of binder resin | |
|---|---|
| Dispersion medium | |
| Water | 180 parts |
| Monomers | |
| Butadiene | 2 parts |
| Styrene | 98 parts |
| Divinyl-benzene | 0.16 part |
| Emulsifiers | |
| Potassium salt of aliphatic acid | 2.2 parts |
| Unhomogenized potassium salt of rhodinic acid | 2.2 parts |
| Potassium phosphate | 0.4 part |
| Polymerization initiator system | |
| Ferrous sulfate | 0.005 part |
| Paramenthane hydroperoxide | 0.02 part |
| t-Dodecyl mercaptan | 3.0 parts |

A nitrogen-purged autoclave (capacity: 20 liters) was charged with the composition of the above formulation, which was subjected to emulsion polymerization at 5° C. When the percentage conversion reached 70% , 0.2 part of N,N'-diethylhydroxylamine (polymerization inhibitor) was added to the reaction system to stop the reaction. An emulsion latex A was obtained. Upon coagulation, the latex provided a low molecular weight styrene/butadiene copolymer having a weight average molecular weight (Mw) of 12,000 and a number average molecular weight (Mn) of 7,000.

A latex B was produced as in the above except that the amounts of styrene, butadiene, divinyl-benzene and t-dodecyl mercaptan were 90 parts, 10 parts, 0.5 part, and 1.1 parts, respectively. Upon coagulation, the latex provided a high molecular weight styrene/butadiene copolymer having a weight average molecular weight (Mw) of 2,000,000 and a number average molecular weight of 30,000.

The latices A and B were mixed in a ratio of 2:3 in terms of solids content. A stabilizer was added to the latex mixture which was then coagulated with calcium chloride (coagulating agent). Upon dehydration and drying, a resin comprising a mixture of a low molecular weight polymer derived from latex A and a high moleuclar weight polymer derived from latex B was obtained. The resin was referred to as Resin 1.

Production of Toner

A binder resin comprising 100 parts of the Resin 1 was mixed with 5 parts of carbon black (colorant), and the mixture was subjected to the conventional method of toner production consisting of preliminary mixing, melting/kneading, grinding and classification, to thereby produce toner particles having an average grains size of 15 microns according to the present invention. The toner was referred to as Sample 1.

EXAMPLE 2

A latex C was produced as in Example 1 except that styrene and t-dodecyl mercaptan were used in amounts of 70 parts and 0.7 part, respectively, and that butadiene and divinyl benzene were replaced by 30 parts of butyl methacrylate and 0.2 part of ethylene glycol dimethacrylate, respectively. Upon coagulation, the latex provided a low molecular weight styrene/ butyl methacrylate copolymer having a weight average molecular weight (Mw) of 100,000, a number average molecular weight (Mn) of 8,000 and a styrene content of 70%.

The latices C and B were mixed in a ratio of 2:1 in terms of solid contents. A stabilizer was added to the latex mixture which was then coagulated with calcium chloride (coagulating agent). Upon dehydration and drying, a resin comprising a mixture of a low molecular weight polymer derived from the latex C and a high molecular weight polymer derived from the latex B was obtained. The resin was referred to as Resin 2.

Production on Toner

A binder resin comprising 100 parts of Resin 2 was mixed with 5 parts of carbon black (colorant) and the mixture was subjected to the conventional method of toner production consisting of preliminary mixing, melting/kneading, grinding and classification, to thereby produce toner particles having an average grain size of 15 microns according to the present invention. The toner was referred to as Sample 2.

COMPARATIVE EXAMPLE 1

Toner particles having an average grain size of 15 microns were produced as in Example 1 except that the binder resin comprised a 2:3 mixture of the low molecular weight styrene/ butadiene copolymer from Latex A and the high molecular weight styrene/butadiene copolymer from Latex B. The toner was referred to as Comparative Sample 1.

COMPARATIVE EXAMPLE 2

Toner particles having an average grain size of 15 microns were produced as in Example 2 except that the binder resin comprised a 2:1 mixture of the low molecular weight styrene/butyl methacrylate copolymer from Latex C and the high molecular weight styrene/butadiene copolymer from Latex B. The toner were referred to as Comparative Sample 2.

PERFORMANCE TESTS

Samples 1 and 2, and Comparative Samples 1 and 2 were checked for their tendency to agglomerate, minimum fixing temperature, durability and grindability.

Agglomeration Test

Fifty grams of each sample was put on a watch glass, left in a constant temperature bath (60° C.) for 48 hours, and checked if any agglomeration occurred.

Minimum Fixing Temperature

Five parts of each sample was mixed with 95 parts of iron powder(carrier) to form a developing agent. The resulting four developing agents were used in the formation of a copy image with an electro-photocopier ("U-Bix V" of Konishiroku Photo Industry Co., Ltd.) by changing the fixing temperature. The minimum temperature to achieve satisfactory fixing was measured for the respective samples.

Durability Test

A deteriorated toner caused toner filming which in turn produced a foggy copy image. So, the durability of each sample was determined by counting how many copies could be made continuously before the fog density exceeded a tolerable value of 0.20.

Grindability

The toner mass before the grinding step in the production of each sample was ground coarsely and then pulverized with a jet pulverizer at a pressure of 6.0 kg/cm$^2$ and a feed rate of 100 g/min. The grindability of the mass was determined by measuring the average grain size of the resulting fine particles.

The results of these tests are shown below.

TABLE

| Factor | Sample 1 | Sample 2 | Comp. Sample 1 | Comp. Sample 2 |
|---|---|---|---|---|
| Agglomeration | no | no | yes | yes |
| Min. fixing tem. (°C.) | 140 | 135 | 150 | 140 |
| Temp. at which off-setting occurred (°C.) | 225 | 210 | 185 | 180 |
| No. of copies | 50,000 | 40,000 | 12,000 | 10,000 |
| Grindability (microns) | 12 | 11 | 30 | 26 |

The above data shows that Samples 1 and 2 are both far better than Comparative Samples 1 and 2 with respect to their resistance to agglomeration, image fixing ability, resistance to offsetting, durability and grindability.

What is claimed is:

1. A toner for developing an electrostatic latent image which comprises a resin prepared by emulsion polymerizing a first polymer to yield a first emulsion, emulsion polymerizing a second polymer to yield a second emulsion, mixing said first and second emulsions and coagulating said mixture wherein said second polymer has characteristics different from those of the first polymer.

2. A toner according to claim 1, wherein said resin comprises a styrene/butadiene copolymer.

3. A toner according to claim 1, wherein said first polymer is a high molecular weight polymer, and wherein said second polymer is a low molecular weight polymer.

4. A toner according to claim 3, wherein said high molecular weight polymer and low molecular weight polymer independently comprise styrene/butadiene copolymer.

5. A toner according to claim 2, wherein said resin further comprises an additional resin being a styrene resin, a styrene-acrylic acid ester copolymer or a styrene-methacrylic acid ester copolymer.

6. A toner according to claim 5, wherein the additional resin is used in an amount of less than 40 wt % of the binder resin.

7. A process for the preparation of a toner for developing an electrostatic latent image which comprises a resin prepared by emulsion polymerizing a first polymer to yield a first emulsion, emulsion polymerizing a second polymer to yield a second emulsion, mixing said first and said second emulsions and coagulating said mixture, wherein said second polymer has characteristics different from those of said first polymer, separating said resin from the emulsion mixture and dehydrating said resin to provide a solid product.

* * * * *